United States Patent [19]

Hanyu et al.

[11] 4,441,439

[45] Apr. 10, 1984

[54] STITCH FUNCTION SWITCHING SYSTEM FOR SEWING MACHINES

[75] Inventors: Susumu Hanyu; Hideaki Takenoya, both of Tokyo, Japan

[73] Assignee: Janome Sewing Machine Co Ltd., Tokyo, Japan

[21] Appl. No.: 275,236

[22] Filed: Jun. 19, 1981

[30] Foreign Application Priority Data

Jun. 27, 1980 [JP] Japan ..... 55-89370

[51] Int. Cl.[3] ..... D05B 3/02

[52] U.S. Cl. ..... 112/158 E

[58] Field of Search ..... 112/158 E, 121.11, 121.12

[56] References Cited

U.S. PATENT DOCUMENTS 4,016,821 4/1977 Minalga ..... 112/158 E
4,237,803 12/1980 Nakanishi ..... 112/158 E
4,318,359 3/1982 Takayama et al. ..... 112/158 E

*Primary Examiner*—Peter P. Nerbun
*Attorney, Agent, or Firm*—Michael J. Striker

[57] ABSTRACT

The sewing machine is provided with two knobs on the front face of the machine housing and a number of switches indicating different stitch patterns to be produced. These knobs may be selectively pushed or rotated to set the sewing machine between a condition in which the needle and the feeding device are set to produce predetermined stitch coordinates of a selected pattern and a condition in which the needle and the feeding device are adjusted to produce adjustable stitch coordinates. The sewing machine further includes switches operated by the aforementioned knobs and an electric memory connected to a manually operated controller and functioning for controlling the swinging amplitude of the needle and the feeding pitch of the feeding device.

6 Claims, 4 Drawing Figures

STITCH FUNCTION SWITCHING SYSTEM FOR SEWING MACHINES

BACKGROUND OF THE INVENTION

The invention relates to an electronic sewing machine, and more particularly relates to a stitch function switching system for such a kind of sewing machine, in which a single operating element is operated to switch the sewing machine from one stitching function to another, especially to enlarge the field of the stitching function of the sewing machine.

According to the conventional electronic sewing machine, the stitch control data are electronically stored to control the stitch forming instrumentalities of the sewing machine to produce a selected pattern of predetermined stitch coordinates. The sewing machine is optionally operated to an automatic or a manually adjustable stitching condition of a selected pattern to produce a predetermined pattern or a modified pattern of the stitches enlarged or reduced with a specific proportional constant on the basis of the selected data of pattern. Such an electronic sewing machine has, as well known, stitching functions each made effective by manual adjusting operations, and therefore such a sewing machine requires so many operating elements in a limited space of the sewing machine. The sewing machine of the type is generally complex with the so many operating elements, and is difficult in operation for selecting a desired one of the stitch functions.

SUMMARY OF THE INVENTION

The present invention has been provided to eliminate the defects and disadvantages of the prior art. For attaining this object, the sewing machine of the invention is provided with at least a single operating element operated in one mode to switch the sewing machine between a plurality of stitch functions including automatic and adjustable usages of the sewing machine, especially for enlarging or reducing the stitches optionally or with a predetermined proportional constant on the basis of the selected control data of the pattern.

In fact, the present invention comprises a drive shaft rotated to vertically reciprocate a laterally swingable needle relative to a fabric to be sewn, a feeding device operated to feed the fabric relative to the needle, a machine drive motor driven by manual operation of a controller to rotate the drive shaft, an electric memory storing stitch control data for controlling the lateral swinging amplitude of the needle and the feeding pitch of the feeding device to produce different stitch patterns, a plurality of pattern selecting switches selectively operated to select many different patterns to be stitched; operating means operated in one mode to switch the sewing machine between a condition in which the needle and the feeding device are automatically set to produce predetermined stitch coordinates of a selected pattern and a condition in which the needle and the feeding device are optionally adjusted to produce so adjusted stitch coordinates of the selected pattern by another operation mode of the operating means; switch means operated in association with the operating means when the latter is operated in said one mode; and stitch function switching means operated in association with the switch means to produce a code signal for determining one of the stitching conditions of the sewing machine, wherein said operating means includes first and second operating knobs each pushed to switch the sewing machine between the first and second conditions, said operating means are rotated to optionally adjust the sewing machine to produce the so adjusted stitch coordinates of the pattern, wherein said first operating knob is rotated to adjust the laterally swinging amplitude of the needle, and is pushed to nullify the rotational operation of the knob and make effective the manual operation of the controller to control the lateral swinging amplitude of the needle, wherein said second operating knob is pushed to switch the sewing machine between a condition in which said feeding device is automatically set to feed the fabric with a predetermined pitch and a condition in which the feeding device is set to feed the fabric with an adjusted pitch by rotational operation of the knob, and wherein said second operating knob is pushed to switch the sewing machine into an additional condition in which said knob is rotated to adjust the number of stitches with a constant feeding pitch to elongate or shorten the selected pattern.

the novel features which are considered as characteristic for the invention are set forth in particular in the appended claims. The invention itself, however, both as to its construction and its method of operation, together with additional objects and advantages thereof, will be best undertstood from the following description of specific embodiments when read in connection with the accompanying drawings.

BRIEF DESCRIPTION OF THE DRAWNGS

DESCRIPTION OF THE PREFERRED EMBODIMENTS

Figure 1:
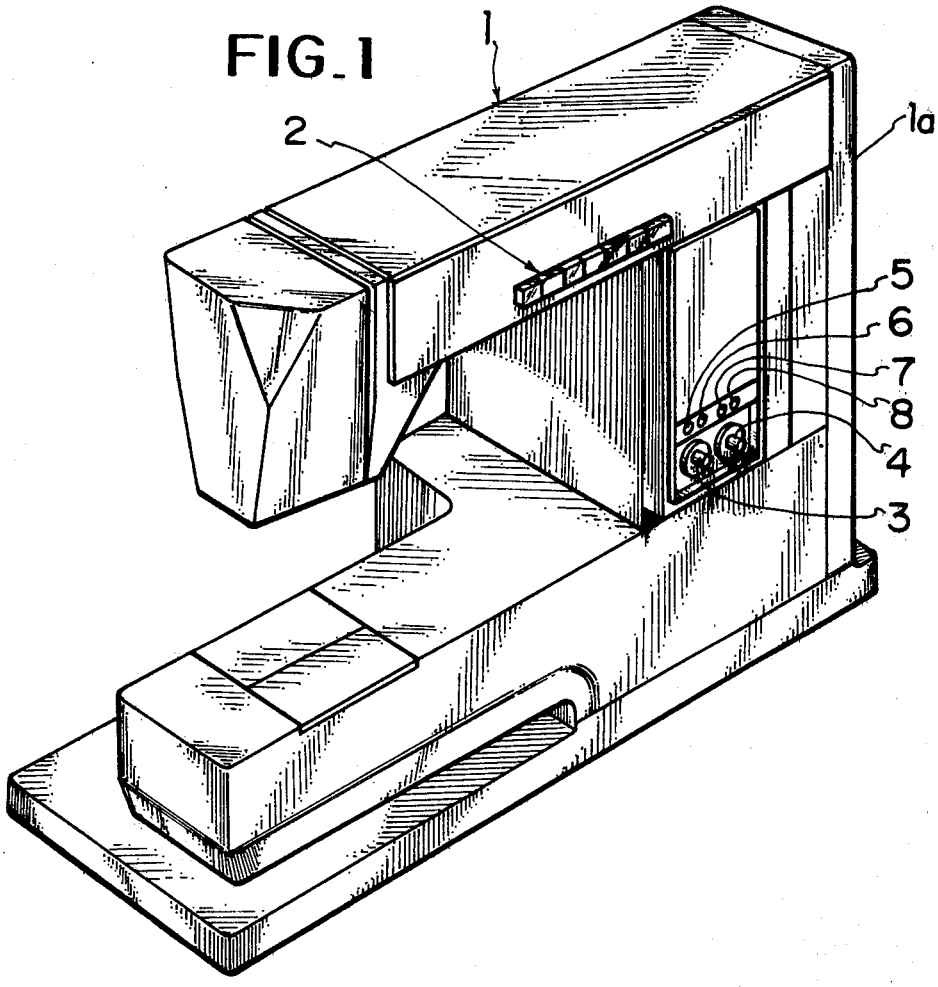
FIG. 1 is a perspective view of a sewing machine incorporated with the invention.

In reference to FIG. 1, a sewing machine 1 defined by a machine housing 1*a* having a number of pattern selecting switches 2 arranged on the front face thereof. A knob 3 is provided on the front face of the machine housing 1*a* as shown, which is normally rotated to adjust the lateral swinging movement of a needle of the sewing machine. The knob 3 is pushed to function in another way as will be described in detail hereinlater. Another knob 4 is provided on the front face of the machine housing 1*a* by the side of the knob 3. The knob 4 normally is rotated to adjust the feeding pitch or amount of a fabric feeding device of the sewing machine, and is pushed to function in another way as will be described in detail hereinlater.

A pair of indication lamps 5, 6 are provided on the front face of the machine housing 1*a* in association with the needle amplitude adjusting knob 3. The indication lamps 5,6 produce the lights of different colours in dependence upon the pushing operations of the knob 3, and selectively indicate the functions of the knob 3. Another pair of indication lamps 7, 8 are provided on the front face of the machine housing 1*a*in association with the feed pitch adjusting knob 4. The indication lamps 7, 8 produce the lights of different colours in dependence upon the pushing operations of the knob 4 and selectively indicate the functions of the knob 4.

Figure 2:
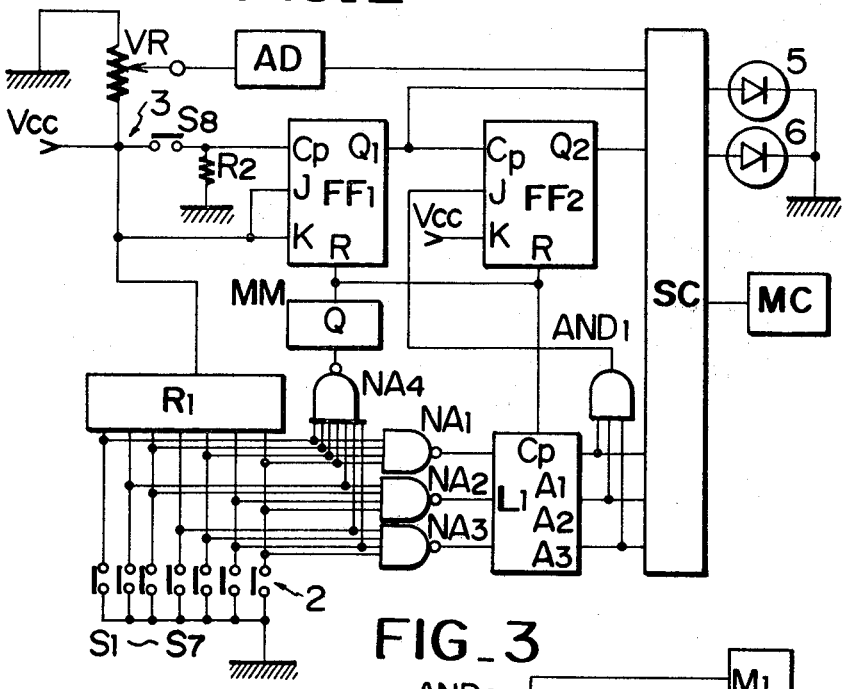
FIG. 2 is a control circuit diagrammatically showing the invention.

FIG. 2 shows a control circuit operated by manipulation of the needle amplitude adjusting knob 3. The control circuit is arranged within the machine housing 1*a*. In the control circuit, the switch components S1–S7 of the pattern selecting switches 2 are normally opened switches each having both ends grounded and each having one end connected to a positive control power supply Vcc through a pull-up resistor R1. These switches S1–S7 are selectively pushed to select so many different patterns of stitches. If one of the switches S1–S7 is pushed, one end of the switch becomes low level, and a group of NAND circuits NA1, NA2, NA3 gives a coded pattern signal to a latch circuit L1. On the other hand, NAND circuit NA4 gives a high level signal to a monostable multivibrator circuit MM which in turn produces at the output Q thereof a trigger signal to the trigger terminal Cp of the latch circuit L1 so that the latch circuit L1 may latch the coded pattern signal.

A stitch control part SC electronically stores the stitch control data for electronically controlling the formation of stitches. The initial stitch control data of a selected pattern is read out by a pattern selecting code composed of the outputs A1, A2, A3 of the latch circuit L1. The stitch control part SC includes a part to control a machine drive motor (not shown).

FF1 and FF2 are flip-flop circuits of a J-K master-slave type each having a reset terminal R connected to the output Q of the monostable multivibrator circuit MM. The flip-flop circuit FF1 has the terminals J, K connected to the power supply Vcc and normally kept high level, and has the trigger terminal Cp connected to one end of a normally opened switch S8 which is closed by pushing operation of the needle amplitude adjusting knob 3. The trigger terminal Cp of the flip-flop circuit FF1 is grounded through a resistor R2 and is normally low level, but becomes high level when the switch S8 is closed, which has the other end connected to the power supply Vcc. The flip-flop circuit FF2 has a terminal J connected to the output side of AND circuit AND1 which has the inputs connected to the outputs A1, A2, A3 of the latch circuit L1, and has a terminal K connected to the power supply Vcc. The flip-flop circuit FF2 has a trigger terminal Cp connected to the output Q1 of the flip-flop circuit FF1. When the trigger terminal Cp is turned to high level from low level, and is turned to low level again, the output Q2 becomes low level if the terminal J is low level, i,e., if any of the outputs A1, A2, A3 is low level. On the other hand, the condition of the output Q2 is inverted if the output A1, A2, A2 are all turned to high level.

The outputs Q1, Q2 are connected to the stitch control part SC and give a binary code to the latter. The needle amplitude adjusting knob 3 is rotated to adjust a variable resistor VR, which is connected to the power supply Vcc, to thereby take out a varied potential. An analog-digital converter AD changes the adjust potential into a digital value and gives the same to the stitch control part SC as the function adjusting data. The indication lamp 5 gives a light when the output Q1 of the flip-flop circuit FF1 is high level, and the indication lamp 6 gives a light when the output Q2 of the flip-flop circuit FF2 is high level.

MC is a machine motor controller to be manipulated by a foot of the machine operator, and is normally used to give an electric signal to the stitch control part SC, to thereby control the rotation speed of the machine drive motor. The machine motor controller MC may be used to control the swinging amplitude of the needle in dependence upon the outputs Q1, Q2 of the flip-flop circuits FF1, FF2 as will be described in detail hereinlater.

The switch 7 is manipulated to cause the latch circuit L1 to give the data 1 1 1 at the outputs A1, A2, A3 thereof which designates the normal zigzag stitches produced by a constant swinging movement of the needle and a constant feeding amount of the fabric feeding device. The other switches S1–S6 are selectively manipulated to cause the latch circuit L1 to give the data at the outputs A1, A2, A3 thereof, any of which including a logic 1, thereby to turn the NAND circuit NA4 to high level designating the straight stitches and other different pattern stitches.

The outputs Q1, Q2, of the flip-flop circuits FF1, FF2 when having the logic values 0 0, nullify the adjusted output of the variable resistor VR and set constant the mechanical changing ratio of the needle amplitude control data at the stitch control part SC. The outputs Q1, Q2, when turned to the logic value 1 0, make effective the adjusted output of the variable resistor VR for controlling the swinging amplitude of the needle. the outputs Q1, Q2, when turned to the logic value 0 1, make ineffective the output of the variable resistor VR and make effective the manipulation of the machine motor controller MC for controlling the swinging amplitude of the needle and for controlling the start as well as the stop of the machine drive motor which is automatically set to rotate at a constant low speed in this case. The outputs Q1, Q2, when turned to the logic value 1 1, make effective the manipulation of the machine motor controller MC for controlling the swinging amplitude of the needle and the start as well as the stop of the machine drive motor, and also make effective the adjusted output of the variable resistor VR for controlling the rotation speed of the machine drive motor. Operation is as follows; If the pattern selecting switch S7 is pushed, the latch circuit L1 has a code 1 1 1 at the outputs A1, A2, A3 thereof, and the stitch control part SC is set for producing the normal zigzag stitches. The terminals J, K of the flip-flop circuits FF1, FF2 become high level. These flip-flop circuits FF1, FF2 are reset at the time of pattern selection and have the logic value 0 0 at the outputs Q1, Q2 thereof, and the swinging amplitude of the needle is automatically determined and the rotational operation of the knob 3 gives no effect. The indication lamps 5, 6 are not lighted at this time.

Then if the knob 3 is pushed and instantly released the flip-flop circuit FF1 has the logic value 1 at the output Q1 thereeof. The flip-flop circuit FF2 therefore becomes high level at the trigger terminal Cp thereof and the condition is maintained. The output Q2 is therefore the logic value 0. With the logic value 1 0 at the outputs Q1, Q2, the knob 3 may be rotated to adjust the swinging amplitude of the needle. This is indicated by the indication lamp 5 giving a light.

Then if the knob 3 is pushed and instantly released again, the outputs Q1, Q2 are turned to the logic value 0 1, and the machine drive motor is automatically set to rotate at a constant low speed, and simultaneously the machine motor controller MC is set to control the swinging amplitude of the needle. This is indicated by the indication lamp 6 giving a light while the indication lamp 5 goes out.

If the knob 3 is pushed and instantly released once more, the outputs Q1, Q2 are turned to the logic value 1 1, and the rotational operation of the knob 3 becomes effective to adjust the rotation speed of the machine drive motor, and the machine motor controller MC is maintained to control the swinging amplitude of the needle. This is indicated by the indication lamp 5 giving a light in addition to the lamp 6.

If the knob 3 is pushed and instantly released once more, the outputs Q1, Q2 are turned to the logic value 0 0 of the initial condition.

The control.circuit in FIG. 2 is so formed that the other patterns selected by maniputation of the other pattern selecting switches S1–S6 require no control of the swinging amplitude of the needle by manipulation of the machine motor controller MC. In this case, the outputs Q1, Q2 of the flip-flop circuits FF1, FF2 are logic value 0 0 which is turned to 1 0 by pushing operation of the knob 3. The logic values 0 0 and 1 0 are alternately repeated by repeatedly pushing the knob 3 to provide the automatically set condition of the swinging amplitude of the needle and the manually adjustable condition of same by means of the rotational operation of the knob 3.

Figure 3:
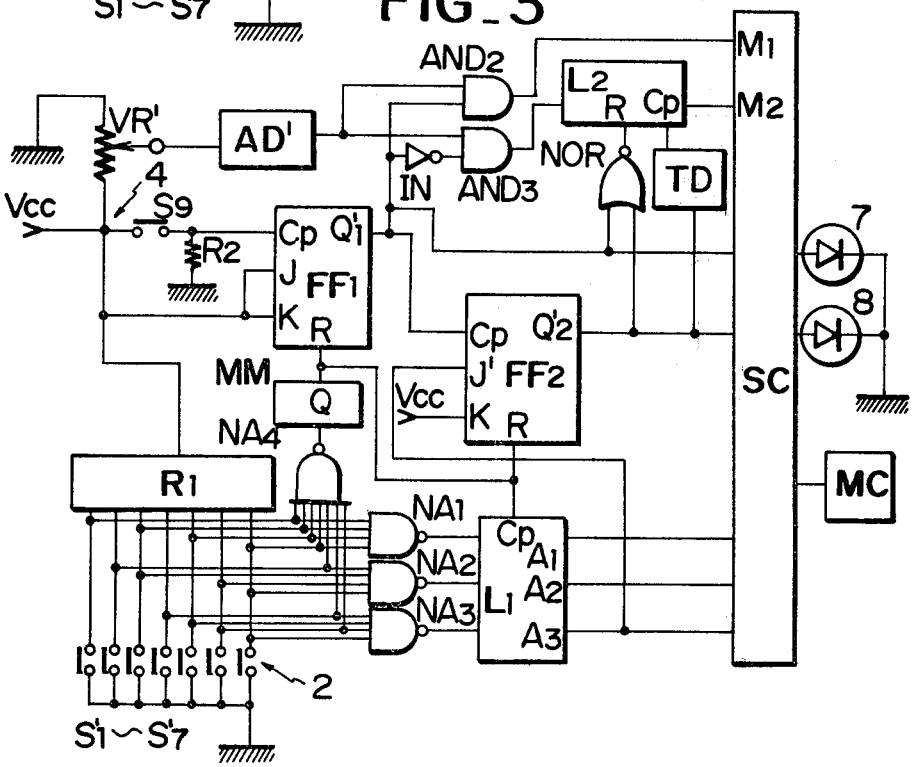
FIG. 3 is another embodiment of a control circuit diagrammatically showing the invention.

FIG. 3 shows a control circuit operated by manipulation of the feed amount adjusting knob 4. The control circuit is so formed as to produce the patterns such as the patterns (A), (B), (C) shown in FIG. 4. The patterns (A), (B), (C) are of the same feeding pitch and of the same type, but are of different numbers of stitches. Thus the pattern (B) is more elongated than the pattern (A), and the pattern (C) is more elongated than the pattern (B).

Figure 4A:
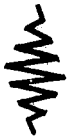
FIG. 4 is a representation of patterns shown by way of example, which are produced by the invention.
Figure 4B:
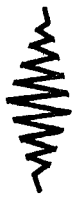
Figure 4C:
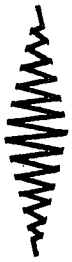

In this control circuit, the knob 4 is pushed, as in the same manner with the knob 3 in FIG. 2, to set the control circuit for automatically determmining the feeding pitch of the pattern, for enabling manual adjustment of the feeding pitch of the pattern by rotation of the knob 4, and for enabling the manul adjustment of elongation of the pattern by rotation of the knob 4 so as to produce a pattern such as the one (B) or (C) on the basis of the pattern (A) as shown in FIG. 4.

In reference to FIG. 3, the control circuit will be explained only as to the parts which are different from the control circuit in FIG. 2. The pattern selecting switches S'4–S'7 are provided to select the patterns to be elongated and the other pattern selecting switches S'1–S'3 are provided to select the patterns which should not be elongated. The flip-flop circuit FF2 has a terminal J' so connected as to have the logic value 0 upon manipulation of any of the pattern selecting switches S'1–S'3, and to have the logic value 1 upon manipulation of any of the switches S'4–S'7.

AND circuit AND2 has an input connected to the output of the analog-digital converter AD' and another input connected to the output Q'1 of the flip-flop circuit FF1. When the output Q'1 is logic value 1, the AND circuit AND2 gives the data of the analog-digital converter AD' to th input terminal M1 of the stitch control part SC.

AND circuit AND3 has an input connected to the output of the analog-digital converter AD' and another input connected, through an inverter IN, to the output Q'1 of the flip-flop circuit FF1. When the output Q'1 is logic value 1, the AND circuit AND3 gives the output of the analog-digital converter AD' to a latch circuit L2. The latch circuit L2 has a reset terminal R connected to the output of NOR circuit NOR, which has an input connected to the output Q'1 of the flip-flop circuit FF1 and another input connected to the output Q'2 of the flip-flop circuit FF2. The latch circuit L2 has a trigger terminal Cp connected to the output Q'2 of the flip-flop circuit FF2 through a time delay circuit TD. When the output Q'1 is logic value 0 and the output Q'2 is logic value 1, the latch circuit L2 gives the output of the analog-digital converter AD' to the input M2 of the stitch control part SC.

The outputs Q'1, Q'2 of the flip-flop circuits FF1, FF2, when having the logic value 0 0, nullify the output of the variable resistor VR' and set the stitch control part SC so as to make constant the mechanical changing ratio of the feed pitch control data at the stitch control part SC. The outputs Q'1, Q'2, when turned to the logic value 1 0, make effective the output of the variable resistor VR' so as to enable the manual adjustment of the feed pitch of a pattern by rotational operation of the knob 4. The outputs Q'1, Q'2, when turned to the logic value 0 1, store the output of the variable resistor VR' into the latch circuit L2 as a value for controlling the feeding pitch of a pattern to be elongated, and automatically determine the number of stitches to produce a standard pattern such as shown in FIG. 4 (A). The outputs Q'1, Q'2, when turned to the logic value 1 1, maintain the stored content in the latch circuit L2 as at the logic value 0 1 at the outputs Q'1, Q'2, and enable the manual adjustment of the number of stitches of the pattern to be elongated by rotational operation of the knob 4, so as to form the patterns such as shown in FIG. 4 (B) and (C) on the basis of the pattern in FIG. 4(A). In this control circuit, the machine motor controller MC is employed to control the rotation speed, the start and stop of the machine drive motor all through the aforementioned logic values at the outputs Q'1, Q'2 of the flip-flop circuits FF1, FF2.

It will be understood that each of the elements described above, or two or more together, may also find a useful application in other types of stitch function switching systems differing from the types described above.

While the invention has been illustrated and described as embodied in a switching system, it is not intended to be limited to the details shown, since various modifications and structural changes may be made without depating in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stitch function switching system for a new sewing machine having a housing, a drive shaft rotatably mounted on the housing to vertically reciprocate a laterally swingable needle relative to a fabric to be sewn, a fabric feeding device operated to feed a fabric relative to the needle, a machine drive motor driven to rotate the drive shaft, an operator-controlled switch (MC) operated to normally control the rotation speed of the machine drive motor, said stitch function switching system comprising a plurality of pattern selecting switches selectively operated to select a plurality of different stitch patterns; stitch control means (SC) including an electronic memory storing stitch control data which are made effective with a selective operation of the pattern selecting switches to control the lateral swinging amplitude of the needle and the fabric feed pitch of the fabric feeding device, in dependence upon a selected pattern, said stitch control means being electrically connected to the operator-controlled switch (MC); manually operated means including a knob (3) which is rotationally operated to adjust the lateral swinging amplitude of the needle and is axially operated to change the function of the sewing machine; function switching means ($S_8$, $FF_1$, $FF_2$) operated in association with the axial operation of the knob (3) to produce a code signal for making effective the operation of the operator-controlled switch (MC) to control the lateral swinging amplitude of the needle.

2. The system of claim 1, wherein said function switching means ($S_8$, $FF_1$k $FF_2$) are operated in association with the axial operation of the knob (3) to produce a code signal for nullifying the rotational operation of the knob to adjust the lateral swingting amplitude of the needle.

3. The system of claim 1, wherein said function switching means ($S_8$, $FF_1$, $FF_2$) are operated in association with the axial operation of the knob to produce a code signal for making effective the rotational operation of the knob and the function of the operator-controlled switch (MC) for speed control of the machine motor while nullifying the function of the operator-controlled switch for controlling the lateral swing amplitude of the needle.

4. The system of claim 1, wherein the function switching means ($S_8$, $FF_1$, $FF_2$) are operated in association with the axial operation of the knob to produce a code signal for setting constant the rotation speed of the machine drive motor irrespectively of the rotational operation of the knob while making effective the function of the operator-controlled switch to control the lateral swinging amplitude of the needle.--

5. The system of claim 1, wherein said function switching means are operated in association with the axial operation of the knob to produce a code signal for making effective the rotational operation of the knob for optionally setting the rotation speed of the machine drive motor while making effective the function of the operator-controlled switch for controlling the lateral swinging amplitude of the needle.

6. A stitch function switching system for a ewing machine having a housing, a drive shaft rotatably mounted on the housing to vertically reciprocate a laterally swingable needle relative to a fabric to be sewn, a fabric feeding device operated to feed a fabric relative to the needle, a machine drive motor driven to rotate the drive shaft, and operator-controlled switch (MC) operated to normally control the rotation speed of the machine drive motor, said stitch function switching system comprising a plurality of pattern selecting switches selectively operated to select a plurality of different stitch patterns; stitch control means (SC) including an electronic memory storing stitch control data which are made effective with a selective operation of the pattern selecting switches to control the lateral swinging amplitude of the needle and the fabric feed pitch of the fabric feeding device in dependence upon a selected pattern, said stitch control means being electrically connected to the operator-controlled switch (MC); manually operated means including a knob (4) which is rotationally operated to adjust the fabric feed pitch of the fabric feeding device and is axially operated to change the function of the sewing machine; function switching means ($S_9$, $FF_1$, $FF_2$) operated in association with the axial operation of the knob to produce a code signal for adjusting the number of stitches with a constant feed pitch to selectively elongate or shorten a selected pattern in accordance with the subsequent rotational operation of the knob.

* * * * *